United States Patent [19]

Kroeker et al.

[11] Patent Number: 4,969,643

[45] Date of Patent: Nov. 13, 1990

[54] EXERCISE APPARATUS

[76] Inventors: Helmut Kroeker, 5 Marcie St., Winnipeg, Manitoba, Canada, R2G 3S4; Peter Kampen, 46 Reiny Dr., Winnipeg, Manitoba, Canada, R2G 2M2

[21] Appl. No.: 362,373

[22] Filed: Jun. 7, 1989

[51] Int. Cl.[5] ..... A63B 21/00

[52] U.S. Cl. ..... 272/130; 272/116; 272/134; 188/312; 188/318

[58] Field of Search ..... 272/93, 116, 117, 130, 272/131, 132, 134; 92/134; 188/312, 313, 318; 417/535, 536, 441

[56] References Cited

U.S. PATENT DOCUMENTS

| | | | |
|---|---|---|---|
| 1,571,788 | 2/1926 | Bramlette, Jr. | 188/318 |
| 3,465,851 | 9/1969 | Callegari et al. | 188/312 |
| 4,063,726 | 12/1977 | Wilson | 272/DIG. 4 X |
| 4,235,437 | 11/1980 | Ruis et al. | 272/134 |
| 4,353,547 | 10/1982 | Jenkinson | 272/134 X |
| 4,609,190 | 9/1986 | Brentham | 272/130 |
| 4,647,041 | 3/1987 | Whiteley | 272/132 |
| 4,667,955 | 5/1987 | Giesch | 272/134 X |
| 4,872,668 | 10/1989 | McGillis et al. | 272/130 |

FOREIGN PATENT DOCUMENTS

| | | | |
|---|---|---|---|
| 8904695 | 6/1989 | World Int. Prop. O. | 272/130 |

*Primary Examiner*—Richard J. Apley
*Assistant Examiner*—Joe H. Cheng

[57] ABSTRACT

The invention is directed to an improved exercise apparatus, of the type having a fixed base and an associated movable portion. A hydraulic system is attached to both by a cylinder, on movement of the movable portion with respect to the base, a hydraulic fluid current is generated through a flow control valve. By adjusting the flow control valve resistance to the current can be varied causing greater or lesser resistance to the exertions of the user of the apparatus. Preferably paired flow control valves are utilized providing adjustable accommodating resistance to movement in either direction. The adjustment controls are conveniently mounted on the movable portion for user/operator access.

20 Claims, 3 Drawing Sheets

EXERCISE APPARATUS

This invention relates to exercise apparatus. In particular it relates to exercise apparatus having a resistance against exertion by the user. Such exercise apparatus is generally used for health, gymnasium and therapeutic purposes.

BACKGROUND OF INVENTION

Such exercise devices are well known, and vary considerably in sophistication from stacked weights and pulleys to highly complex computerized apparatus. What is lacking is an effective method of controlling the resistance apart from simple varying of the weights, especially what is lacking is a method of having easily adjustable different resistances in opposite exercise directions. The simplest form is to develop the muscle by using the muscle in one mode, contraction or extension against resistance, and relaxing it in the other mode usually either against little or no resistance, or against negative resistance, where some exertion has to be applied to prevent too rapid a return to the start position. This does not take into account situations where different resistance is required in both directions. Preferably any resistance is accommodating, that is it varies increasing with exertion applied.

It is principal object of the invention to provide an exercise apparatus providing continuously adjustable accommodating resistance in at least one directional mode of exercise. Other and further objects will become apparent to those skilled in the art from the specification, claims and drawings.

DESCRIPTION OF THE PRIOR ART

Exercise apparatus incorporating constant resistance are known. U.S. Pat. No. 4,647,041 issued Mar. 3, 1987 to Whiteley, teaches an apparatus including a base, a pedestal fixed to the base, a counterweighted bifurcated (sic) arm rotatably mounted on a shaft in the top of the pedestal, and a resistance generating device. The resistance generating device includes a disc fixedly mounted on the shaft, caliper brake means mounted on the pedestal engaging the disc, and means to adjust the caliper brake means pressure on the disc. Means to transmit the motion of the arm to the disc are provided. These take two forms, in one exemplified form the motion of the arm may be transmitted in one direction at a time only, to the disc, upwards or downwards at choice, in the other unexemplified form the motion of the arm can be transmitted in both directions. In the exemplified form reversible means to engage the disc ratchet style in either direction are provided, by movement of a control lever one means can engage the disc. In use of the exemplified form, the resistance is adjusted, then the disc is engaged in the desired direction, the user then exercises pushing the bifurcated arm against resistance in one direction, with no resistance in the other direction. In use of the unexemplified form, the resistance is adjusted, and the disc is engaged, apparently in both directions, and the user then exercises pushing the bifurcated arm against resistance in both directions.

Applicant did not build the single direction device of Whiteley as the components are neither standard, nor readily available, and custom made components are too expensive to be economic. Also resistance could be applied only in one direction at a time for exercising purposes. In the theoretical bidirectional form one can only have the identical resistance in both directions. Applicant found that adjustable accommodating resistance in both directions was desirable.

DESCRIPTION OF THE INVENTION

It has recently been emphasized that regular physical exercise has medical and health benefits. This has been shown be advantageous not only in maintaining health, but in developing muscles, and in therapeutic rehabilitation. It has been further shown to be advantageously applied to the handicapped and elderly. There is consequently an increasing demand for apparatus which may be usefully employed in all these areas. Whiteley in his patent, has developed a device which, in theory, meets these needs by providing an extremely versatile device capable of use in a wide variety of exercises, made more so by use of a work bench and treadmill.

In one broad aspect the invention is directed to an improved apparatus for exercise including base means and movable means mounted thereon, the improvement comprising hydraulic system means attached to the base means and the movable means, whereby movement of the movable means with respect to the base means actuates the hydraulic system means generating adjustable resistance to the movement in at least one direction, by adjustable flow control means. Typically the hydraulic system means comprises cylinder means operatively associated with the base means and piston means operatively associated with the movable means. Conveniently the cylinder means has first inlet means and first outlet means adjacent a first end of the cylinder means and second inlet means and second outlet means adjacent a second end of the cylinder means, each outlet means having associated outlet line means, each outlet line means having adjustable flow control means, the outlet line means communciating with the inlet line means through the adjustable flow control means, when the piston means is moved hydraulic fluid is forced through one of the flow control means generating resistance against the piston means. Preferably the flow control means are flow control valves, allowing free flow toward the cylinder outlet means and adjustable restricted flow away from the cylinder outlet means, the outlet line means have check valve means adjacent the outlet means allowing free flow away from the outlet means and preventing free flow toward the outlet means, and the inlet line means have check valve means adjacent the inlet means, allowing free flow toward the inlet means and preventing free flow away from the inlet means. Suitably the adjustment means comprise rotatable knobs operatively associated with the flow control means. For convenience of the user/operator the rotatable knobs are mounted on the movable means.

In another broad aspect the invention is directed to an improved apparatus for exercise including base means associated pedestal means and arm means rotatably mounted on the pedestal means, the improvement comprising hydraulic system means attached to the pedestal means and the arm means, whereby movement of the arm means with respect to the pedestal means actuates the hydraulic system means generating adjustable resistance to the movement in at least one direction. Preferably the hydraulic system means generates resistance to the movement by adjustable flow control means. Typically the hydraulic system means comprises cylinder means operatively associated with the pedestal means and piston means operatively associated with the arm means. Usually the cylinder means has first inlet means and first outlet means adjacent a first end of the cylinder means and second inlet means and second outlet means adjacent a second end of the cylinder means each outlet means having associated outlet line means, each outlet line means having adjustable flow control means, the outlet line means communicating with the inlet line means through the adjustable flow control means, when the piston means is moved hydraulic fluid is forced through one of the flow control means generating resistance against the piston means. Desirably the flow control means are flow control valves, allowing free flow toward the cylinder outlet means and adjustable restricted flow away from the cylinder outlet means. Preferably the outlet line means have check valve means adjacent the outlet means allowing free flow away from the outlet means and preventing free flow toward the outlet means and the inlet line means have check valve means adjacent the inlet means, allowing free flow toward the inlet means and preventing free flow away from the inlet means. The adjustment means may comprise rotatable knobs operatively associated with the flow control means. For convenience of the user/operator the rotatable knobs are mounted on the arm means.

In a further broad aspect the invention is directed to an apparatus for exercise comprising base means adapted to rest on a level substrate, the base means having a generally level top surface, the base means including pedestal means fixed to one end of the base means extending vertically upward therefrom, the pedestal means having opposed horizontal shaft retaining bores therein, shaft means captivated within the shaft retaining bores providing mounting means, bifurcated arm means rotatably mounted on the shaft means having hand grips thereon, hydraulic cylinder means attached to the pedestal means and the arm means, the cylinder means including piston means, the cylinder means having first inlet means and first outlet means adjacent a first end of the cylinder means and second inlet means and second outlet means adjacent a second end of the cylinder means each outlet means having associated outlet line means, each outlet line means having adjustable flow control means, the outlet line means communicating with the inlet line means through the adjustable flow control means, when the arm means is axially rotated in a first direction the piston means is actuated forcing hydraulic fluid through one the flow control means, and when the arm means is axially rotated in a second direction the piston means is actuated forcing hydraulic fluid through the other the flow control means, adjustment means to adjust separately each the adjustable flow control means, whereby resistance to the rotation can be varied separately in each of the directions. Preferably flow control means are flow control valves, allowing free flow toward the cylinder outlet means and adjustable restricted flow away from the cylinder outlet means. Desirably the outlet line means have check valve means adjacent the outlet means allowing free flow away from the outlet means and preventing free flow toward the outlet means. Conveniently the inlet line means have check valve means adjacent the inlet means, allowing free flow toward the inlet means and preventing free flow away from the inlet means. Typically the piston means includes piston rod means operatively associated with the arm means, and the cylinder means is operatively associated with the pedestal means. Preferably the adjustment means comprise rotatable knobs operatively associated with the flow control means. For convenience of the user/operator the rotatable knobs are mounted on the arm means.

Advantageously a bench is provided with the apparatus, to enable a wide variety of exercises to be performed.

As would be understood by those skilled in the art, the inlet lines are conveniently joined into a single line by a junction member, as are the outlet lines by a junction member beyond the paired flow control valves. Conventionally the single inlet and outlet lines are connected through a hydraulic fluid reservoir. The apparatus uses conventional hydraulic fluids.

The apparatus itself does not require a counter weight, because the hydraulic system usually provides enough inertia for the arm to prevent too rapid a return of the arm to its rest position. The hydraulic system still provides some inertia even when both flow control valves are set to minimum flow control (free flow).

DESCRIPTION OF PREFERRED EMBODIMENT

Preferred embodiments are indicated in the drawings where:

Figure 2:
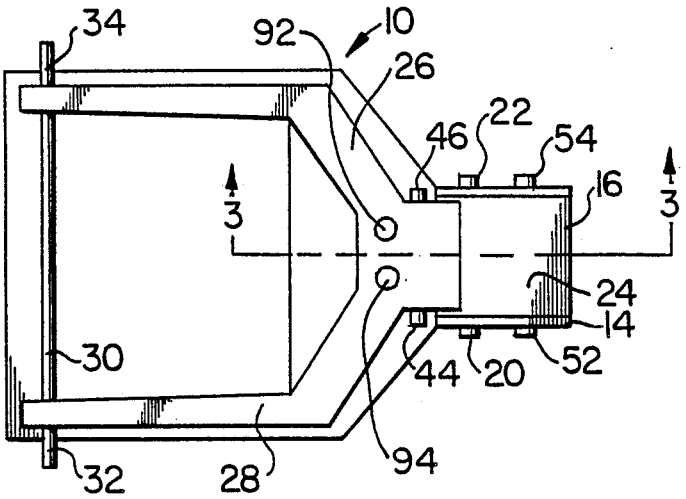
FIG. 2 shows a top view of the embodiment of FIG. 1.
Figure 3:
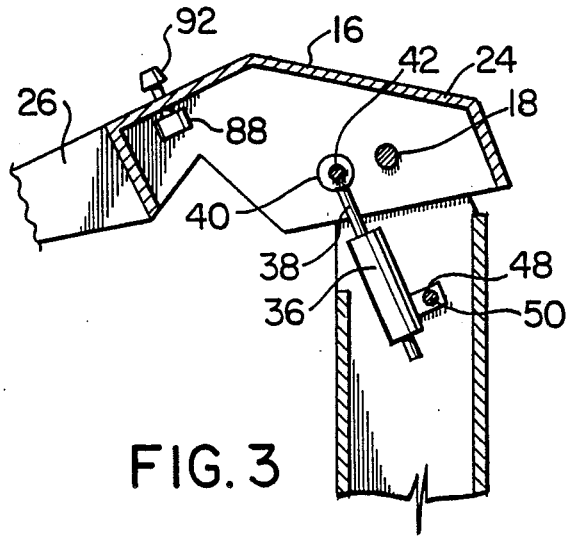
FIG. 3 shows a part sectional view of the embodiment of FIG. 1.

The general description of the invention is now expanded by reference to the drawings, which illustrate preferred embodiments of the invention. The device generally indicated by 10, has a base 12, adapted to rest on substrate 9, pedestal 14 extends upward from base 12, and has arm structure 16, rotatably mounted in pedestal 14, by pin 18 which is secured to pedestal 14, by collars 20 and 22 (as shown in FIG. 2). Arm structure 16 has rear portion 24 and paired forks 26 and 28, which extend forward in the horizontal position to nearly the end of base 12, adjacent the ends of forks 26 and 28 is transverse handle bar 30, which extends outward of the forks, where it is covered by hand grips 32 and 34. Resistance to motion is provided by hydraulic cylinder 36, which as shown in FIG. 3 has piston rod 38 attached by integral ring or collar 40 to pin 42, pin 42 is secured to rear arm portion by collars 44 and 46, the cylinder 36 is attached by side bracket 48 to pin 50, which is secured to pedestal 14 by collars 52 and 54. The hydraulic system is omitted from FIGS. 1 to 3 except for the cylinder 36 and control knobs 92 and 94, and flow control valve 88, which are indicated as to position.

Figure 4:
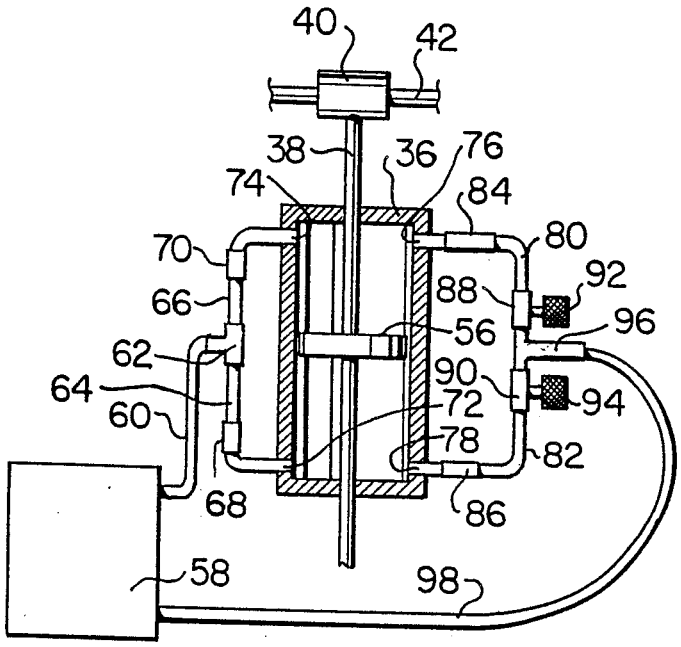
FIG. 4 shows a schematic view of a preferred hydraulic system of the invention.

The hydraulic system as shown in FIG. 4 includes cylinder 36, having piston rod 38, which has ring or collar 40 attached to pin 42, piston rod 38 mounts piston 56 which moves with piston rod 38. Reservoir 58 has outlet (suction) line 60 which communicates with T junction member 62, and lines 64, and 66, line 64 communicates with cylinder opening 72, through check valve 68, which allows flow from the reservoir to the cylinder but not the reverse flow from the cylinder to the reservoir, line 66 similarly communicates with cylinder opening 74, through check valve 70, which allows flow from the reservoir to the cylinder but not the reverse flow from the cylinder to the reservoir. Cylinder 36 has other openings 76 and 78, line 80 communicates with cylinder opening 76 and T junction member 96 through check valve 84, which allows flow from the cylinder but not to the cylinder, and adjustable flow control valve 88, adjustable by rotatable knob 92, flow control valve 88 allows free flow towards the cylinder and controlled flow away from the cylinder toward T junction member 96, similarly line 82 communicates with cylinder opening 78 and T junction member 96 through check valve 86, which allows flow from the cylinder but not to the cylinder, and adjustable flow control valve 90, adjustable by rotatable knob 94, flow control valve 90 allows free flow towards the cylinder and controlled flow away from the cylinder toward T junction member 96, line 98 completes the circuit from T junction member 96, to reservoir 58, forming the inlet (pressure) line.

Figure 1:
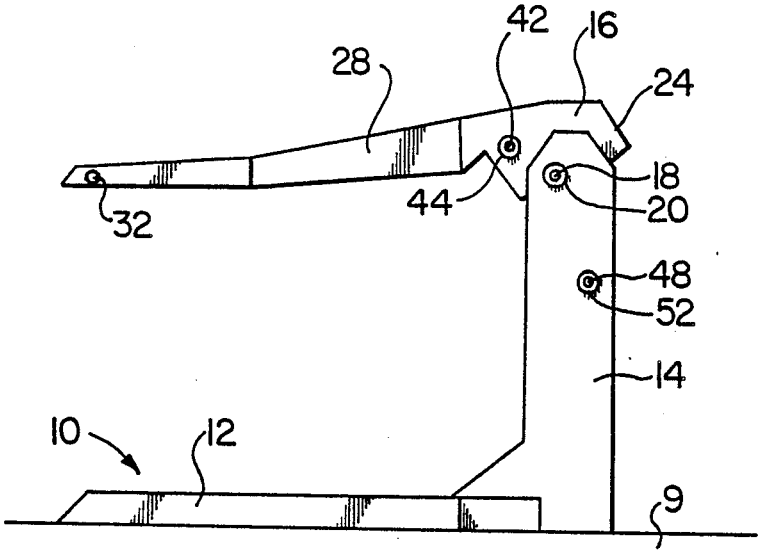
FIG. 1 shows a side view of a preferred embodiment of the invention.

In use starting from the position shown in FIG. 1 the user raises the arm, and thus pin 42 moving piston rod 38, and piston 56 upward, hydraulic fluid tries to flow out of openings 74 and 76, shutting check valve 70, and opening check valve 84, the fluid passes out through opening 76 into line 80, through check valve 84, and through flow control valve 88, which depending on the setting provides more or less or zero resistance to the fluid flow, this resistance can be adjusted by rotation of knob 92 to the needs of the user. The fluid then tries to flow through T junction member 96 into lines 82 and 98, any fluid flow through flow control valve 90 shuts check valve 86, the fluid flows along line 98 into reservoir 58. The upward motion of piston 56 creates flow from openings 72 and 78, opening check valve 68 and closing check valve 86, the flow from the reservoir thus passes along line 60 through T junction member 62 into line 64, through check valve 68 into opening 72. The sole flow control device operative in the circuit in this mode is flow control valve 88.

When the user lowers the arm pin 42 collar 40 piston shaft 38 and piston 56 move downward, hydraulic fluid tries to flow out of openings 72 and 78, shutting check valve 68, and opening check valve 86, the fluid passes out through opening 78 into line 82, through check valve 86, and through flow control valve 90, which depending on the setting provides more or less or zero resistance to the fluid flow, this resistance can be adjusted by rotation of knob 94 to the needs of the user. The fluid then tries to flow through T junction member 96 into lines 80 and 98, any fluid flow through flow control valve 88 shuts check valve 84, the fluid flows along line 98 into reservoir 58. The downward motion of piston 56 creates flow from openings 74 and 76, opening check valve 70 and closing check valve 84, the flow from the reservoir thus passes along line 60 through T junction member 62 into line 66, through check valve 70 into opening 74. The sole flow control device operative in the circuit in this mode is flow control valve 90.

Thus by adjustment of flow control valves 88 and 90, the resistance to motion of the arm in either direction can be independently varied. The system is also very simple only two adjustments are necessary, and there is only one moving part—the piston—in use.

The control knobs 92 and 94 are placed on the top surface of the rear arm portion 24, with flow control valves 88 and 90 in the interior of the rear portion of the arm. This is for the convenience of the user in adjusting the flow control valves. The location of the control knobs and valves is not critical of itself, in theory they could be anywhere in the device accessible from outside, desirably they should be close to the cylinder, to reduce hydraulic line length.

The components used in this hydraulic circuit are all standard conventional components, the reservoir-cylinder inlet (suction) lines are $\frac{3}{8}$ inch (9.5 mm) diameter, while the cylinder-reservoir outlet pressure lines are $\frac{1}{4}$ inch (6.35 mm) diameter, the check valves in the inlet lines are consequently $\frac{3}{8}$ inch diameter, while the check and control valves in the outlet lines are $\frac{1}{4}$ inch diameter. As would be appreciated by those skilled in the art these components can be varied and substituted without changing the operation of the system.

As those skilled in the art would realise these preferred illustrated dimensions, details and components can be subjected to substantial variation, modification, change, alteration, and substitution without affecting or modifying the function of the illustrated embodiments. Although embodiments of the invention have been described above, it is not limited thereto, and it will be apparent to persons skilled in the art that numerous modifications and variations form part of the present invention insofar as they do not depart from the spirit, nature and scope of the claimed and described invention.

We claim:

1. An apparatus for exercise including base means and movable means mounted thereon, and hydraulic system means attached to said base means and said movable means, said hydraulic system means comprising cylinder means, piston means; hydraulic fluid, said cylinder means comprising adjacent a first end thereof first inlet means and first outlet means, and adjacent a second end thereof second inlet means and second outlet means, each of said outlet means having associated outlet line means, each of said outlet line means including separate adjustable flow control means adapted to restrict flow of said hydraulic fluid from said cylinder means, each of said inlet means having associated inlet line means, and means in fluid communication with each said inlet line means and each said outlet line means, each of said separate adjustable flow control means allowing variation of restriction of outward flow of hydraulic fluid from said cylinder means through said associated outlet line means to control the amount of pressure required to move said piston means in the direction of outward flow of hydraulic fluid, whereby exercise resistance is generated to the movement of said piston means in the direction of outward flow of hydraulic fluid, each of said separate adjustable flow control means being independently adjustable.

2. The apparatus of claim 1, wherein said separate adjustable flow control means are continuously adjustable from free flow.

3. The apparatus of claim 1, wherein said separate adjustable flow control means are flow control valves, said flow control valves being adapted to restrict outward flow of hydraulic fluid from said cylinder means through said associated outlet line means, and said flow control valves being adapted to allow free flow toward said cylinder means through said associated outlet line means, and said outlet line means have check valve means adjacent said outlet means, adapted to allow free flow away from said outlet means and to prevent free flow toward said outlet means, and said inlet line means have check valve means adjacent said inlet means, adapted to allow free flow toward said inlet means and to prevent free flow away from said inlet means.

4. The apparatus of claim 1, wherein said separate adjustable flow control means comprise rotatable knobs operatively associated with said flow control valves.

5. The apparatus of claim 4, wherein said rotatable knobs are mounted on said movable means.

6. The apparatus of claim 1, wherein said cylinder means is operatively associated with said base means and said piston means is operatively associated with said movable means.

7. An apparatus for exercise including base means associated pedestal means and arm means rotatably mounted on said pedestal means, and hydraulic system means attached to said pedestal means and said arm means, said hydraulic system means comprising cylinder means, piston means, hydraulic fluid, said cylinder means comprising adjacent a first end thereof first inlet means and first outlet means, and adjacent a second end thereof second inlet means and second outlet means, each of said outlet means having associated outlet line means, each of said outlet line means including separate adjustable flow control means adapted to restrict flow of said hydraulic fluid from said cylinder means, each of said inlet means having associated inlet line means, and means in fluid communication with each of said inlet line means and each of said outlet line means, each said separate adjustable flow control means allowing variation of restriction of outward flow of hydraulic fluid from said cylinder means through said associated outlet line means to control the amount of pressure required to move said piston means in the direction of outward flow of hydraulic fluid, whereby exercise resistance is generated to the movement of said piston means in the direction of outward flow of hydraulic fluid, each of said separate adjustable flow control means being independently adjustable.

8. The apparatus of claim 7, wherein said cylinder means is operatively associated with said pedestal means and said piston means operatively associated with said arm means.

9. The apparatus of claim 7, wherein said separate adjustable flow control means are continuously adjustable from free flow.

10. The apparatus of claim 7, wherein said separate adjustable flow control means are flow control valves, said flow control valves being adapted to restrict outward flow of hydraulic fluid from said cylinder means through said associated outlet line means, and said flow control valves being adapted to allow free flow toward said cylinder means through said associated outlet line means.

11. The apparatus of claim 10, wherein said outlet line means have check valve means adjacent said outlet means, adapted to allow free flow away from said outlet means and to prevent free flow toward said outlet means, and said inlet line means have check valve means adjacent said inlet means, adapted to allow free flow toward said inlet means and to prevent free flow away from said inlet means.

12. The apparatus of claim 11, wherein said separate adjustable flow control means comprise rotatable knobs operatively associated with said flow control valves.

13. The apparatus of claim 12, wherein said rotatable knobs are mounted on said movable means.

14. An apparatus for exercise comprising base means adapted to rest on a level substrate, said base means having a generally level top surface, said base means including pedestal means fixed to one end of said base means extending vertically upward therefrom, said pedestal means having opposed horizontal shaft retaining bores therein, shaft means captivated within said shaft retaining bores providing mounting means, bifurcated arm means rotatably mounted on said shaft means having hand grips thereon, and hydraulic system means attached to said pedestal means and said bifucated arm means, said hydraulic system means comprising cylinder means, piston means, hydraulic fluid, said cylinder means comprising adjacent a first end thereof first inlet means and first outlet means, and adjacent a second thereof second inlet means and second outlet means, each of said outlet means having associated outlet line means, each of said outlet means including separate adjustable flow control means adapted to restrict flow of said hydraulic fluid from said cylinder means, each of said inlet means having associated inlet line means, means in fluid communication with each of said inlet line means and each of said outlet line means, and each of said separate adjustable flow control means allowing variation of restriction of outward flow of hydraulic fluid from said cylinder means through said associated outlet means to control the amount of pressure required to move said piston means in the direction of outward flow of hydraulic fluid, whereby exercise resistance is generated to the movement of said piston means in the direction of outward flow hydraulic fluid, each of said separate adjustable flow control means being independently adjustable.

15. The apparatus of claim 14, wherein said separate adjustable flow control means are continuously adjustable from free flow.

16. The apparatus of claim 14, wherein said separate adjustable flow control means are flow control valves, said flow control valves being adapted to restrict outward flow of hydraulic fluid from said cylinder means through said associated outlet line means, and said flow control valves being adapted to allow free flow toward said cylinder means through said associated outlet line means.

17. The apparatus of claim 16, wherein said outlet line means have check valve means adjacent said outlet means, adapted to allow free flow away from said outlet means and to prevent free flow toward said outlet means, and said inlet line means have check valve means adjacent said inlet means, adapted to allow free flow toward said inlet means and to prevent free flow away from said inlet means.

18. The apparatus of claim 17, wherein said piston means is operatively associated with said bifurcated arm means, and said cylinder means is operatively associated with said pedestal means.

19. The apparatus of claim 18, wherein said separate adjustable flow control means comprise rotatable knobs operatively associated with said flow control valves.

20. The apparatus of claim 19, wherein said rotatable knobs are mounted on said arm means.

* * * * *